US009114412B2

(12) United States Patent
Omori et al.

(10) Patent No.: US 9,114,412 B2
(45) Date of Patent: Aug. 25, 2015

(54) ELECTROSTATIC ATOMIZATION DEVICE

(75) Inventors: Takafumi Omori, Osaka (JP); Takayuki Nakada, Shiga-ken (JP); Hiroshi Suda, Osaka (JP); Junpei Oe, Osaka (JP); Kentaro Kobayashi, Hyogo-Ken (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 748 days.

(21) Appl. No.: 13/392,956

(22) PCT Filed: Sep. 13, 2010

(86) PCT No.: PCT/JP2010/066117

§ 371 (c)(1),
(2), (4) Date: Feb. 28, 2012

(87) PCT Pub. No.: WO2011/037075

PCT Pub. Date: Mar. 31, 2011

(65) Prior Publication Data

US 2012/0160940 A1 Jun. 28, 2012

(30) Foreign Application Priority Data

Sep. 25, 2009 (JP) ..... 2009-221514

(51) Int. Cl.

| | |
|---|---|
| ***B05B 5/00*** | (2006.01) |
| ***F23D 11/32*** | (2006.01) |
| ***B05B 5/025*** | (2006.01) |
| ***B05B 5/057*** | (2006.01) |

(52) U.S. Cl.

CPC ..... *B05B 5/0255* (2013.01); *B05B 5/057* (2013.01)

(58) Field of Classification Search

CPC ..... B05B 5/057; B05B 5/0255

USPC ..... 239/690, 706, 102.1, 690.1, 128

See application file for complete search history.

(56) References Cited

U.S. PATENT DOCUMENTS

| | | | | |
|---|---|---|---|---|
| 6,471,753 | B1 * | 10/2002 | Ahn et al. | 96/27 |
| 7,314,185 | B2 * | 1/2008 | Nishi et al. | 239/102.1 |
| 2006/0131449 | A1 * | 6/2006 | Azukizawa et al. | 239/690.1 |
| 2008/0130189 | A1 * | 6/2008 | Kobayashi et al. | 361/228 |
| 2009/0001200 | A1 | 1/2009 | Imahori et al. | |
| 2009/0134248 | A1 | 5/2009 | Yamaguchi | |

FOREIGN PATENT DOCUMENTS

| | | | |
|---|---|---|---|
| EP | 1733797 | A1 | 12/2006 |
| EP | 2065097 | A1 | 6/2009 |
| JP | 2006-000826 | A | 1/2006 |
| JP | 2007-275797 | | 10/2007 |
| JP | 2007-275801 | A | 10/2007 |
| WO | WO 2005/042171 | A1 | 5/2005 |

* cited by examiner

*Primary Examiner* — Dinh Q Nguyen

(74) *Attorney, Agent, or Firm* — Wolf, Greenfield & Sacks, P.C.

(57) ABSTRACT

An electrostatic atomization device that prevents the cooling capability from being lowered due to contact of an atomization electrode with another ember, while effectively preventing surplus production of condensed water that would destabilize discharging at the distal end of the atomization electrode. the electrostatic atomization device includes an atomization electrode having a cylindrical electrode body and a base which is informed at a basal end of the electrode body and has a larger diameter than the electrode from the base to produce condensed water on the atomization electrode. Voltage is applied to the atomization electrode when the condensed water is produced to generate charged fine water droplets. A partition plate includes an insertion hole that receives the electrode body of the atomization electrode. The partition plate and the base of the atomization electrode form a water collection region in between.

7 Claims, 3 Drawing Sheets

ELECTROSTATIC ATOMIZATION DEVICE

This application is a U.S. National Phase of International Application No. PCT/JP2010/066117, filed on Sep. 13, 2012, which claims priority to Japanese Patent Application No. 2009-221514, filed on Sep. 25, 2009. The entirety of which is herein incorporated by reference.

BACKGROUND OF THE INVENTION

The present invention relates to an electrostatic atomization device that generates charged fine water droplets with condensed water.

Japanese Laid-Open Patent Publication No. 2006-000826 describes an electrostatic atomization device that cools an atomization electrode to produce condensed water. The electrostatic atomization device applies voltage to the atomization electrode to generate charged fine water droplets from the condensed water at the distal end of the atomization electrode.

As shown in FIG. 3, the electrostatic atomization device includes plural pairs of thermoelectric elements 2 held between first and second circuit plates 50, which form a heat conversion block 60. A circuit pattern 52 is formed on one surface of each of the first and second circuit plates 50. The circuit pattern 52 of the first circuit plate 50 is electrically connected to a heat dissipation end of each thermoelectric element 2. The circuit pattern 52 of the second circuit plate 50 is electrically connected to a heat absorption end of each thermoelectric element 2.

The second circuit plate 50, which is used for heat absorption, of the heat conversion block 60 is connected to a cooling plate 70, which is thermally conductive. The cooling plate 70 is connected to a basal portion of an atomization electrode 1. The atomization electrode 1 includes a cylindrical electrode body 1*a* and a base 1*b*, which is formed at a basal end of the electrode body 1*a* and has a larger diameter than the electrode body 1*a*. A housing 40 forces the base 1*b* of the atomization electrode 1 toward the cooling plate 70. This holds the base 1*b* between the housing 40 and the cooling plate 70 and thereby fixes the overall atomization electrode 1.

In the above-described electrostatic atomization device of the prior art, the housing 40 is forced against the base 1*b* of the atomization electrode. This conveys heat between the housing 40 and the atomization electrode 1 and thereby lowers the cooling efficiency of the atomization electrode 1.

To resolve this problem, for example, the base 1*b* of the atomization electrode 1 may be spaced apart from the housing. However, this would expose the base 1*b* to ambient air and produce condensed water on the exposed surface of the base 1*b*. As the condensed water grows, the mass of the condensed water may connect to the condensed water produced at a distal end of the electrode body 1*a*. This may destabilize discharging at the distal end of the electrode body 1*a*.

In this manner, it is difficult for the electrostatic atomization device to resolve the problem of the cooling capability being lowered due to contact of the atomization electrode 1 with another member and the problem of discharging being unstable at the distal end of the atomization electrode due to surplus production of the condensed water.

DISCLOSURE OF THE INVENTION

It is an object of the present invention to provide an electrostatic atomization device that prevents the cooling capability from being lowered due to contact of the atomization electrode with another member, while effectively preventing surplus production of condensed water that would destabilize discharging at the distal end of the atomization electrode.

One aspect of the present invention is an electrostatic atomization device including an atomization electrode including a cylindrical electrode body and a base, which is formed at a basal end of the electrode body and has a larger diameter than the electrode body. A cooling means cools the atomization electrode from the base to produce condensed water on the atomization electrode, in which voltage is applied to the atomization electrode when the condensed water is produced to generate charged fine water droplets. A partition plate includes an insertion hole into which the electrode body of the atomization electrode is inserted. The partition plate and the base of the atomization electrode form a water collection region in between.

DESCRIPTION OF EMBODIMENTS

Figure 1:
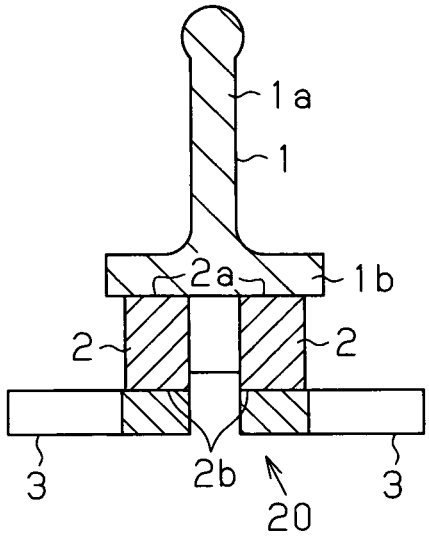
FIGS. 1(*a*) and 1(*b*) are explanatory diagrams showing the main part of an electrostatic atomization device according to one embodiment of the present invention, in which FIG. 1(*a*) shows a state without a partition plate, and FIG. 1(*b*) shows a state including the partition plate.
Figure 1:
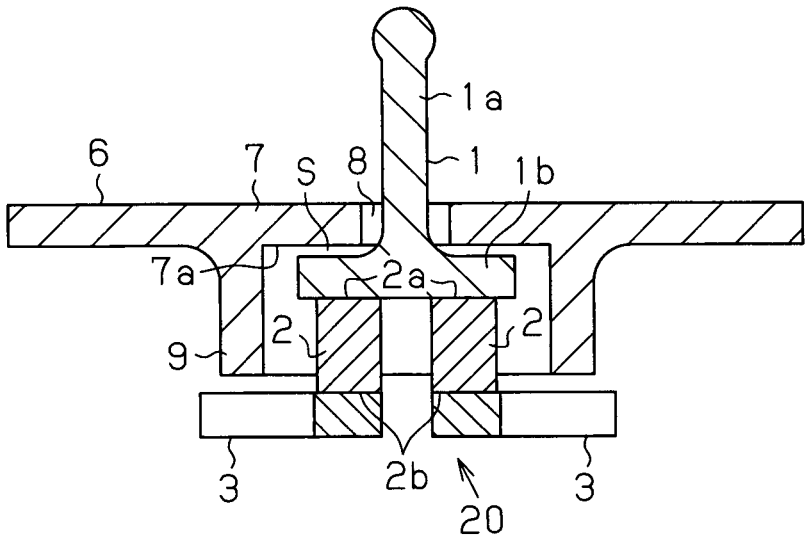
Figure 2:
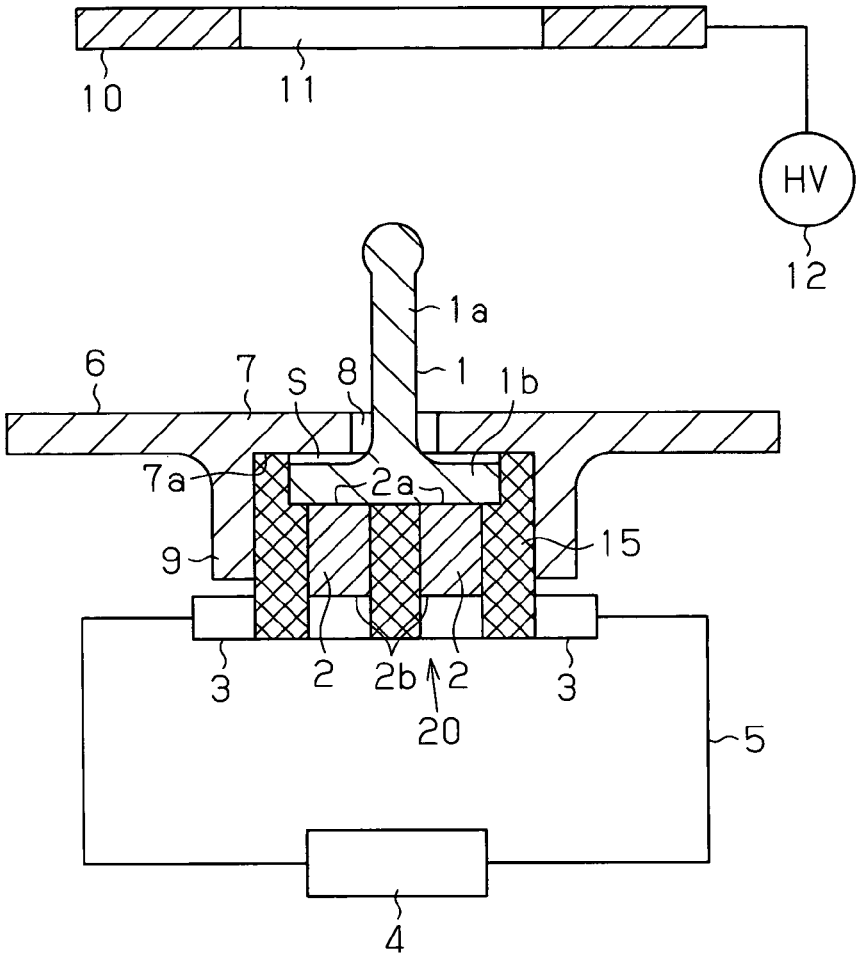
FIG. 2 is an explanatory diagram showing the electrostatic atomization device.
Figure 3:
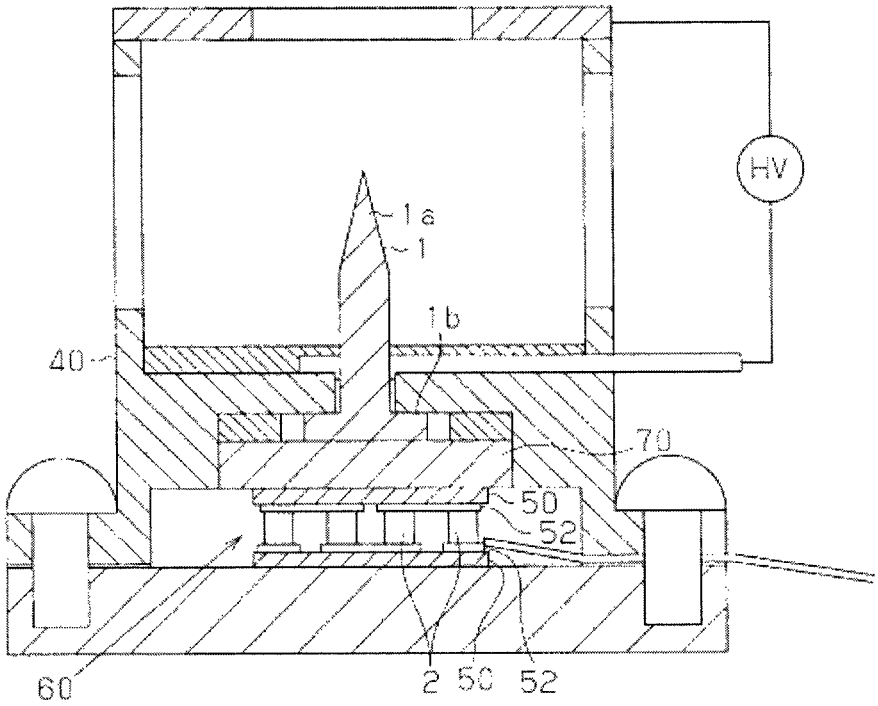
Fig.3 (Prior Art)
FIG. 3 is an explanatory diagram showing an electrostatic atomization device of the prior art.

An electrostatic atomization device according to one embodiment of the present invention will now be discussed with reference to the drawings. FIGS. 1 and 2 show one example of the basic structure of the electrostatic atomization device.

The electrostatic atomization device includes a cooling unit 20, which serves as a cooling means for cooling an atomization electrode 1. The cooling unit 20 includes a pair of thermoelectric elements 2. The pair of thermoelectric elements 2 includes a P type thermoelectric element and an N type thermoelectric element. Each thermoelectric element has a heat absorption surface 2*a* and a heat dissipation surface 2*b*. The heat absorption surface 2*a* is connected to the atomization electrode 1.

More specifically, the heat absorption surfaces 2*a* of the two thermoelectric elements 2 are mechanically and electrically connected to a bottom surface of a base 1*b* of the atomization electrode 1. The heat dissipation surface 2*b* of each thermoelectric element 2 is connected to a heat dissipation conductive member 3, which is formed from an electrically and thermally conductive material (e.g., brass, aluminum, and/or copper). The heat dissipation conductive members 3, which are connected to the thermoelectric elements 2, are both electrically connected to a voltage application unit 4 of a DC power supply via a lead 5 so as to form a circuit. In the cooling unit 20 of the present embodiment, BiTe Peltier elements are used as the thermoelectric elements 2. The cooling unit 20 may include plural pairs of the thermoelectric elements 2.

The atomization electrode 1 includes the base 1*b*, which is planar, and an electrode body 1*a*, which projects from a central part of the base 1*b*. The atomization electrode 1 may be formed from a metal, such as brass, aluminum, copper, tungsten, and titanium. As long as the electrical conductivity is high, the atomization electrode may be formed from other materials, such as a conductive resin and carbon. The thermoelectric elements 2 each have an end that is coupled by solder to the bottom surface of the base 1*b* of the atomization electrode 1. The surface of the atomization electrode 1 may be plated with nickel so that the thermoelectric elements 2 are soldered and coupled in a satisfactory manner. Alternatively, the surface of the atomization electrode 1 may be plated with gold or platinum to increase corrosion resistance.

In the electrostatic atomization device of the present embodiment, the two heat absorption surfaces 2*a* of the two thermoelectric elements 2 are electrically connected to each other by the base 1*b* of the atomization electrode 1. The heat dissipation conductive members 3, the lead 5, and the voltage application unit 4 electrically connect the two heat dissipation surfaces 2*b* of the two thermoelectric elements 2.

In the electrostatic atomization device of the present embodiment, when current flows between the two thermoelectric elements 2 through the atomization electrode 1, the thermoelectric elements 2 directly cool the atomization electrode 1. This produces condensed water on the surface of the atomization electrode 1. In this state, when positive high voltage is supplied to an opposing electrode 10, the electric field formed between the opposing electrode 10 and the atomization electrode 1 applies negative high voltage to the condensed-water produced on the distal end of the atomization electrode 1. The negative high voltage causes an electrostatic atomization phenomenon that generates a large amount of charged fine water droplets from the condensed water generated at the distal end of the atomization electrode 1. The charged fine water droplets have droplets diameters of nanometer size. The generated charged fine water droplets are attracted toward the opposing electrode 10 and forcibly sent out of the electrostatic atomization device through a release port 11 of the opposing electrode 10.

The electrostatic atomization device of the present embodiment has a feature in which a partition plate 6 is arranged so as to cover the base 1*b* of the atomization electrode 1 from above, as viewed in FIG. 2. The partition plate 6 controls the production of condensed water on the atomization electrode 1.

The partition plate 6 includes a partition body 7 and a sealing wall 9. An insertion hole 8 extends through the partition body 7 in a thicknesswise direction (i.e., vertical direction as viewed in FIGS. 1 and 2). The sealing wall 9 extends from a first surface 7*a* of the partition body 7. The electrode body 1*a* of the atomization electrode 1 is inserted into the insertion hole 8 with a predetermined gap extending between the electrode body 1*a* and the wall that defines the insertion hole 8. The sealing wall 9 is arranged at a predetermined location so as to allow for the insertion of the electrode body 1*a* of the atomization electrode 1 into the insertion hole 8 of the partition body 7. The predetermined location is set so that the sealing wall 9, which is tubular, surrounds the base 1*b* of the atomization electrode 1 and the thermoelectric elements 2, which are connected to the base 1*b*.

The predetermined location of the partition plate 6 relative to the atomization electrode 1 is as shown in FIGS. 1(*b*) and 2. More specifically, the predetermined location is set so that a small water collection region S is formed between the flat surface of the partition body 7 and the flat surface of the base 1*b* on the side of the electrode body 1*a*. These flat surfaces of the partition body 7 and the base 1*b* are parallel and face toward each other. The water collection region S is formed so as to be in communication with the insertion hole 8 of the partition body 7.

A sealant 15 is disposed between the tubular sealing wall 9 of the partition plate 6 and the base 1*b* and thermoelectric elements 2, which are surrounded by the sealing wall 9. The sealant 15 is formed, for example, from a thermosetting resin or ultraviolet curing resin. The sealant 15 seals each thermoelectric element 2. However, the sealant 15 does not fill the area between the partition body 7 of the partition plate 6 and the base 1*b* of the atomization electrode 1 (i.e., water collection region S) so as to ensure provision of a water collection region S.

Due to the arrangement of the partition plate 6, the electrostatic atomization device of the present embodiment prevents the cooling capability from being lowered as would occur when the atomization electrode 1 is in contact with another member, while effectively preventing surplus production of condensed water that would destabilize discharging at the distal end of the atomization electrode.

More specifically, when current flows between the two thermoelectric elements 2 through the atomization electrode 1, the thermoelectric elements 2 directly cool the atomization electrode 1 from the base 1*b*. This produces condensed water on the surface of the atomization electrode 1. The condensed water, which is produced on the surface of the base 1*b*, collects and fills the water collection region S. In this state, ambient air does not enter the water collection region S, which is filled with condensed water, through the insertion hole 8. This prevents condensed water from growing into masses on the base 1*b* of the atomization electrode 1 and thereby prevents condensed water from connecting to the condensed water on the distal end of the electrode body 1*a*.

Further, the water collection space S is formed between the base 1*b* of the atomization electrode 1 and the partition plate 6. Only condensed water is filled in the water collection region S. Thus, the atomization electrode 1 and the partition plate 6 are not directly connected with each other. Accordingly, heat is not directly conveyed between the atomization electrode 1 and the partition plate 6. This prevents the cooling efficiency of the atomization electrode 1 from being lowered.

In particular, the heat absorption surface 2*a* of each thermoelectric element 2 is electrically connected to the base 1*b* of the atomization electrode 1 in the electrostatic atomization device of the present embodiment. This vigorously cools the base 1*b* so that condensed water is easily produced. Accordingly, the water collection region S is effective for simultaneously preventing the conveying of heat in the base 1*b* and the growth of the condensed water.

Further, the electrostatic atomization device includes the sealing wall 9, which extends from the partition body 7 and seals the thermoelectric elements 2. This facilitates management of the amount of the sealant 15, which seals the thermoelectric elements 2, and the determination of the positions for sealing the thermoelectric elements 2. Further, the partition plate 6 is discrete from a housing (not shown) of the electrostatic atomization device. This further prevents heat loss through the partition plate 6.

The electrostatic atomization device includes the opposing electrode 10. However, even when the electrostatic atomization device does not include the opposing electrode 10, high voltage may be applied to the condensed water on the distal end of the atomization electrode 1 to generate the charged fine water droplets. In this case, to generate the charged fine water droplets, the voltage application unit 4 of the DC power supply is formed so that a negative high voltage is applied to the entire circuit including the thermoelectric elements 2 and an offset voltage is applied between the two thermoelectric elements 2. As a result, the electrostatic atomization device produces condensed water on the atomization electrode 1 as current flows between the thermoelectric elements 2, while applying high voltage to the atomization electrode 1 to produce condensed water.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

The invention claimed is:

1. An electrostatic atomization device comprising:

an atomization electrode including a cylindrical electrode body and a base, which is formed by a basal end of the electrode body and has a larger diameter than the electrode body;

a cooling means for cooling the atomization electrode from the base to produce condensed water on the atomization electrode, in which voltage is applied to the atomization electrode when the condensed water is produced to generate charged fine water droplets; and a partition plate including an insertion hole into which the electrode body of the atomization electrode is inserted, wherein the partition plate and the base of the atomization electrode form a water collection region in between.

2. The electrostatic atomization device according to claim 1, wherein the cooling means includes a cooling unit having two thermoelectric elements connected to the atomization electrode and the partition plate includes a sealing wall that forms a region for sealing the two thermoelectric elements.

3. The electrostatic atomization device according to claim 2, wherein the region formed by the sealing wall receives a sealant to seal the two thermoelectric elements, wherein the partition plate, the base of the atomization electrode, and the sealant define the water collection region.

4. The electrostatic atomization device according to claim 1, wherein the cooling means includes a cooling unit having two thermoelectric elements, and each of the two thermoelectric elements includes a heat absorption surface electrically connected to the base of the atomization electrode.

5. The electrostatic atomization device according to claim 1, wherein the water collection region is filled with condensed water produced on a surface of the base.

6. The electrostatic atomization device according to claim 1, wherein the cooling means includes to thermoelectric elements connected to the atomization electrode for cooling the atomization electrode from the base to produce condensed water on the atomization electrode, which thermoelectric elements including a heat absorption surface and a heat dissipation surface with the heat absorption surface connected to the atomization electrode.

7. The electrostatic atomization device according to claim 1, wherein the partition plate has a lower surface and the atomization electrode has an upper surface facing the lower surface, wherein the lower surface and the upper surface from the water collection region in between.

* * * * *